US007166420B2

(12) United States Patent
Chopra et al.

(10) Patent No.: US 7,166,420 B2
(45) Date of Patent: Jan. 23, 2007

(54) PROTECTION OF TRANSIENT DOCUMENTS USING A PHOTOCHROMIC PROTECTIVE LAYER

(75) Inventors: Naveen Chopra, Oakville (CA); Hadi Mahabadi, Mississauga (CA); Peter M. Kazmaier, Mississauga (CA); Gabriel Iftime, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/139,890

(22) Filed: May 27, 2005

(65) Prior Publication Data

US 2006/0269878 A1 Nov. 30, 2006

(51) Int. Cl.

| | |
|---|---|
| ***G03C 1/675*** | (2006.01) |
| ***G03C 1/685*** | (2006.01) |
| ***G03C 1/73*** | (2006.01) |
| ***G03C 1/815*** | (2006.01) |
| ***G03C 1/825*** | (2006.01) |

(52) U.S. Cl. ..... 430/339; 430/333; 430/335; 430/338; 430/345; 430/962

(58) Field of Classification Search ..... 430/333, 430/335, 338, 339, 962, 345
See application file for complete search history.

(56) References Cited

U.S. PATENT DOCUMENTS

| | | | | |
|---|---|---|---|---|
| 3,511,653 | A * | 5/1970 | Wiebe | 430/5 |
| 4,199,359 | A | 4/1980 | Weigl et al. | |
| 4,942,113 | A * | 7/1990 | Trundle | 430/326 |
| 5,155,607 | A | 10/1992 | Inoue et al. | |
| 5,529,864 | A * | 6/1996 | Tachibana et al. | 430/20 |
| 6,066,420 | A | 5/2000 | Ohtsu et al. | |
| 6,340,544 | B1 | 1/2002 | Akutsu et al. | |
| 6,517,618 | B1 | 2/2003 | Foucher et al. | |
| 6,680,003 | B1 | 1/2004 | Chuard et al. | |
| 6,696,229 | B1 * | 2/2004 | Dukler et al. | 430/333 |
| 2005/0244742 | A1 * | 11/2005 | Iftime et al. | 430/270.1 |

FOREIGN PATENT DOCUMENTS

| | | |
|---|---|---|
| JP | 7-326076 | * 12/1995 |
| JP | 8-315419 | * 11/1996 |

* cited by examiner

*Primary Examiner*—Richard L. Schilling
(74) *Attorney, Agent, or Firm*—Fiena O. Palazzo; Fay, Sharpe, Fagan, Minnich & McKee, LLP

(57) ABSTRACT

A protective, switchable layer adapted for use in transient imageable documents is disclosed. The protective layer can be disposed on an underlying photochromic layer and enables writing or imaging the underlying layer. The protective layer prevents unintentional writing on the photochromic layer, such as can otherwise occur from exposure to certain wavelengths of light.

20 Claims, 8 Drawing Sheets
(1 of 8 Drawing Sheet(s) Filed in Color)

FIG. 3
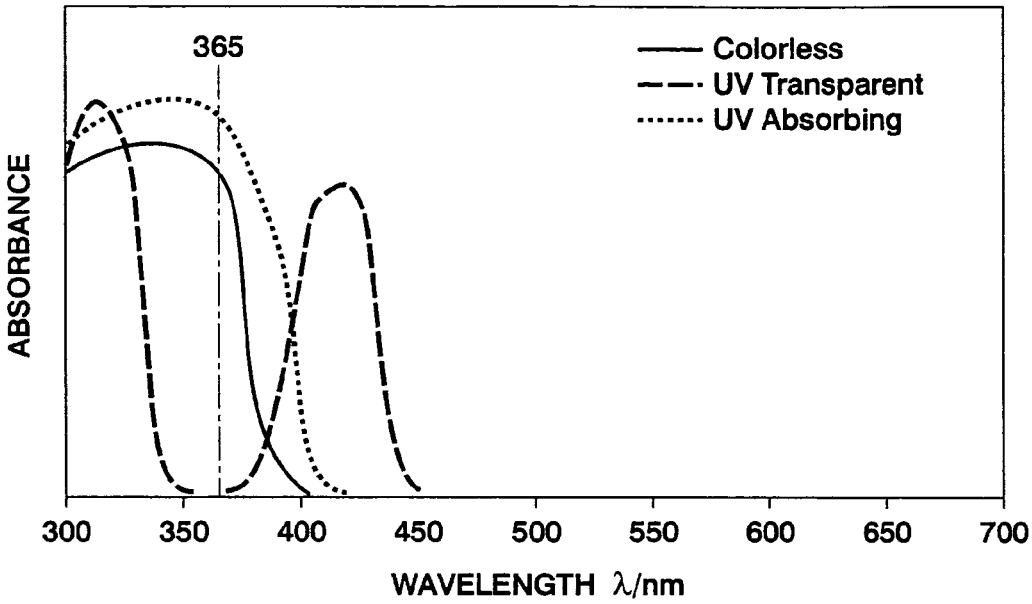
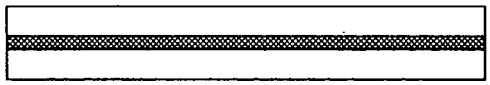
FIG. 4A
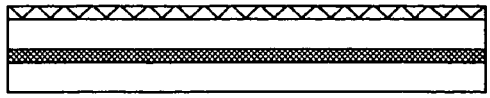
FIG. 4B
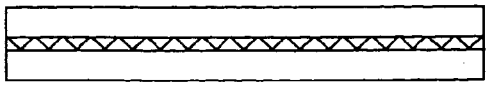
FIG. 4C

PROTECTION OF TRANSIENT DOCUMENTS USING A PHOTOCHROMIC PROTECTIVE LAYER

BACKGROUND

The present disclosure relates, in various exemplary embodiments, to the protection of documents using a top protective photochromic switchable layer.

Photochromic self-erasing, reimageable paper is written by using UV light of 365 nm wavelength. The printed information is readable for a predetermined period of time, for example 4 hours. After passage of a longer time period, for example 20 hours, the printed information is self-erasing, leaving a blank document ready to be reimaged with new information. These documents are often referred to as temporary or transient documents.

Because UV light is used both for writing, as well as for reading (UV light is typically present in room-light from a bulb or sunlight), the unimaged areas of the document are sensitive to the UV component from the reading light. And so, unimaged areas become colored after a period of time, thereby reducing the contrast between the white and colored states, and thus reducing the readability of the document. This is illustrated schematically in FIG. 1, wherein contrast degradation of temporary documents under ambient light is depicted. As the document is continually exposed to ambient light or sunlight, the UV component of light causes a gradual, uncontrolled writing on the document background areas, causing contrast loss.

This problem has previously been addressed by creating a band-pass window for the incident light capable of isomerising (i.e. inducing coloration) the material, centered around 365 nm. The stability of such transient documents has been significantly improved, when compared to unprotected documents. However, the unimaged areas of the documents are still sensitive to the UV component of visible light, centered at 365 nm. It would be beneficial if the transient document were protected against ambient UV light over the entire UV region.

BRIEF DESCRIPTION

The present disclosure, in various exemplary embodiments, provides a selectively imageable and protected member having an imaging state and a reading state. The member comprises a display layer in which the display layer is imageable upon exposure to light of a first wavelength. The member also comprises a protective layer disposed on the display layer. The protective layer is at least substantially transparent to and non-absorbing of light of the first wavelength when the member is in the imaging state. The protective layer is also substantially non-transparent to and absorbing of light of the first wavelength when the member is in the reading state.

In another exemplary embodiment, a protected imageable member is provided comprising a display layer imageable upon exposure to light of a first wavelength, and a protective layer disposed on the display layer. The protective layer transforms from a first state to a second state in which the protective layer is substantially transparent to and non-absorbing of light of the first wavelength upon exposure to light of the first wavelength. After a period of time, the protective layer reverts to the first state.

In yet another exemplary embodiment, a protected imageable member is provided comprising a display layer imageable upon exposure to light of a first wavelength, and a protective layer disposed on the display layer. The protective layer comprises at least one agent selected from the group consisting of chromenes (napthopyrans), diaryperfluorocyclopentenes, azobenzene derivatives, and combinations thereof.

These and other non-limiting features and/or characteristics of the present disclosure will be discussed in more detail below.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The following is a brief description of the drawings, which are presented for the purposes of illustrating the exemplary embodiments disclosed herein and not for the purposes of limiting the same.

FIG. 3 illustrates absorbance graphs as a function of wavelength for two photochromic layers in an exemplary embodiment member.

FIG. 4 is a schematic illustrating a configuration for an exemplary embodiment member.

DETAILED DESCRIPTION

Figure 1:
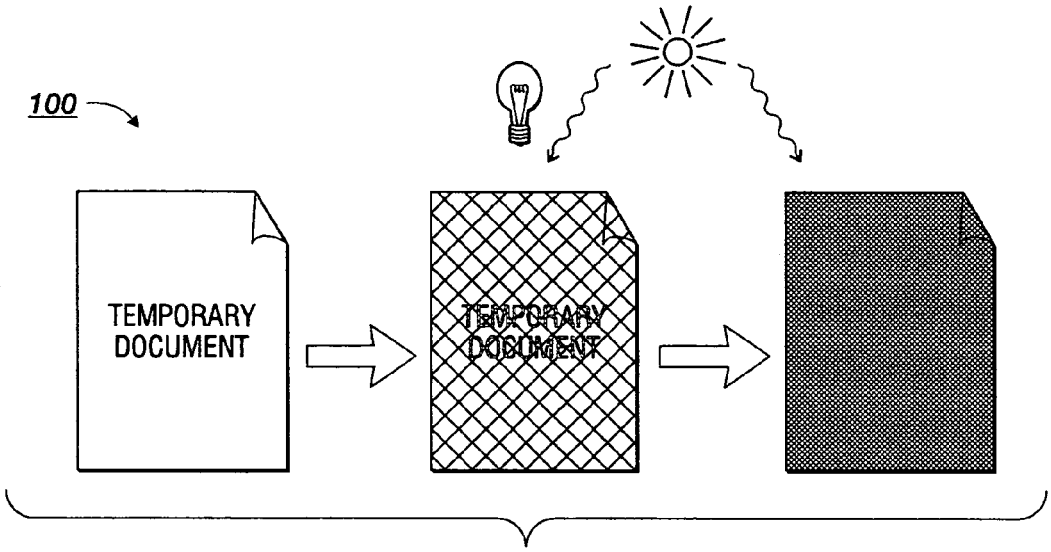
FIG. 1 is a schematic illustrating contrast degradation of temporary documents.

The exemplary embodiment provides a protective photochromic switchable layer for the prevention of coloration of blank or unwritten areas of transient documents by stray UV light from ambient light sources.

Merely covering the transient document layer with UV absorbing material is not sufficient, because while this provides protection against ambient UV light it prevents writing on the transient document.

The top protective layer needs to be capable of switching between two states under illumination with strong UV light, where the light serves as the writing light for the bottom layer of the transient document.

One state is transparent to incident UV light, allowing writing on the bottom transient document layer. This state is obtained by illumination with UV light of high intensity, during the writing process. Alternately, this state can be obtained by illumination with light of a wavelength different than that of UV light, such as for example, less than or greater than the wavelength of UV light.

The second state is UV absorbing. The material freely reverts back to this state a few minutes after writing. Alternatively, this state can be left by illumination with light of a particular wavelength, such as light having a wavelength greater than or less than the wavelength of UV light. In this state, the material protects the active layer of the transient document against ambient UV light in the room light.

More specifically, the exemplary embodiment provides a strategy for protecting the unimaged areas of transient documents or other members, by using a photochromic protective layer (PPL) disposed on an underlying photochromic display layer (PDL).

In the exemplary embodiment, when writing on a photochromic display layer of a temporary document (PDL), the top PPL layer is in a state, which is transparent to UV light (365 nm). After writing, the PPL switches to a second state, in a defined period of time, which has high absorbance in the UV region of the spectrum, and which is stable under ambient conditions. This top PPL layer absorbs the UV component of the incident ambient light, preventing further uncontrolled writing on the unimaged areas of the PDL. The cycle is reversible, so that the paper, document, or other member can be reimaged again, after erasing or self-erasing.

The period of time in which the PPL reverts from its state of substantially transparent and non-absorbing of UV light, to its substantially non-transparent and UV-absorbing state can be from about 0.1 seconds to about 600 minutes, more particularly from about 1 second to about 60 minutes, and more particularly from about 10 seconds to about 30 minutes.

Exemplary embodiment transient documents protected with a photochromic layer can be produced by first coating a paper sheet with a first layer containing photochromic display material (PDL), for example a spiropyran compound, dispersed in a polymeric binder. This sheet is then coated with a second layer containing the photochromic protective material into a polymeric binder (PPL). The protected sheet has the appearance and feeling of paper. Alternatively, the paper can be made by coating with only a single layer, which contains both PDL and PPL photochromic materials dispersed in a polymeric binder, on the paper.

When writing on the exemplary embodiment photochromic layer, the PPL is switched to a state that is transparent to UV light. The UV light passes through this photochromic layer and reaches the bottom PDL photochromic layer. UV illuminated areas induce the isomerisation process which transforms the colorless state of the photochromic material into its colored state. Readable information is displayed on the paper. After the image is written, the top PPL switches to a second state, where it has high absorption of the UV light. Being absorbed by the top layer, the light cannot reach the bottom PDL. In this way the light cannot produce damage (coloration) to the unwritten areas of the printed transient document. The paper is stable against coloration from the ambient UV light. The principle of the exemplary embodiment is illustrated in FIG. 2.

Figure 2A:
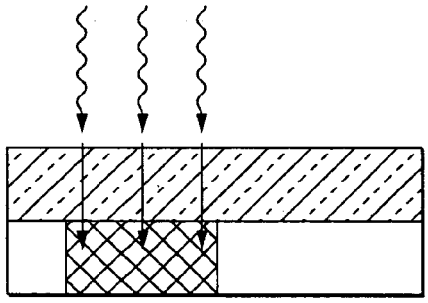
FIG. 2 is a schematic depiction of an exemplary embodiment layered transient document during a UV writing stage and a reading stage.
Figure 2B:
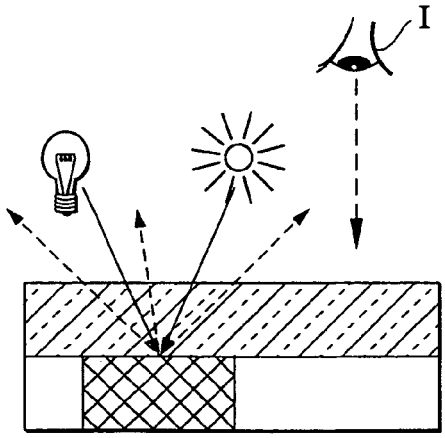

Referring further to FIG. 2, a writing process (left) and a reading process (right) are shown. When writing on the photochromic display layer (PDL), the top photochromic protective layer (PPL) is transparent to UV light and the UV light produces coloration of the PDL layer. When reading, the PPL is in a state, which absorbs ambient UV light. Ambient UV light cannot color the PDL.

The writing process on transient documents by using UV light only requires that enough UV light reach the bottom photochromic layer to induce the noted isomerization process.

The top and bottom photochromic materials are complementary in nature. In this case, the property of interest is absorption in the UV region, which can be modulated by the wavelength of irradiated incident light. Another aspect of the exemplary embodiment is that the PPL material should be transparent to visible light when the transient document is read, but should absorb the UV light, in order to protect the written information.

Referring further to FIG. 2, the PPL can be colorless or transparent, such as when not absorbing light in the visible region in both a writing state and a reading state. Alternatively, the PPL can absorb visible colored light in the writing state (UV transparent state), as long as the PPL does not absorb UV light at 365 nm. In the event that the PPL is colored, the colored state of the PPL should not absorb so much that it interferes with the contrast of the underlying PDL. A maximum wavelength of up to 430–450 nm (yellow to red) is acceptable. The principle for both situations is schematically illustrated in FIG. 3.

FIG. 3 illustrates PPL design based on absorption properties of the two states: one that does not absorb at 365 nm, and so allows writing on the photochromic layer and one that absorbs UV light, and thus protects the document after writing. The transparent state at 365 nm can be either colorless (left) or slightly colored (right), with a slight absorption at 430–450 nm (yellow-red).

Three classes of photochromic materials can be used as the PPL in the exemplary embodiment. The classes include chromenes (napthopyrans), diaryperfluorocyclopentenes, azobenzene derivatives, and combinations thereof. Chromene 1, shown below exhibits a maximum wavelength at 432 nm, which is only slightly colored. This compound is described in Hepworth, et al., *Color Science* '98, vol. 1: Dye and Pigment Chemistry, J. Griffiths, (Ed.) University of Leeds, 1999, pp 161–73, herein incorporated by reference.

I

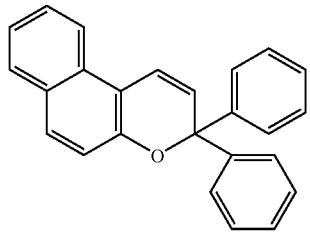

BMAB (4-butyl-4'-methoxyazobenzene) 2, shown below is described in a paper by Tamai and Miyasaka, *Chem. Rev.* 2000, 100, 1875–90, herein incorporated by reference. BMAB undergoes a cis-trans isomerization and a large change in absorbance. The trans absorption band is centered between 320–350 nm (with significant absorption at 366 nm), and the cis absorption band is centered between 260–300 nm leaving the 366 nm window open for writing on the PDL.

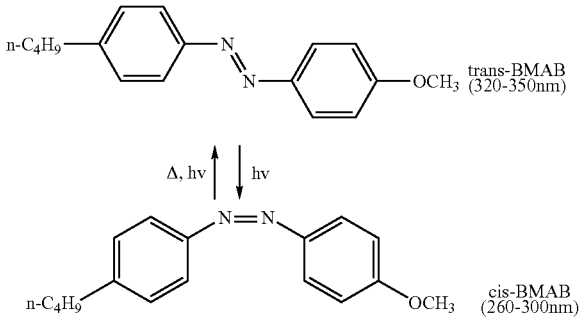

2

Irie, *Chem Rev.* 2000, 100, 1685–1716, herein incorporated by reference, describes a diarylperfluorocyclopentene that has a maximum wavelength at 425 nm in the closed form 3b. In the open form 3a, the maximum wavelength is 336 nm. Alteration of the substituents should allow one to tune the open form absorbance to occur at 366 nm. A specific example of the noted diarylperfluorocyclopentene is dithienylethene (DTE), shown below.

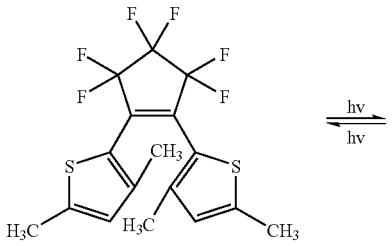

3a

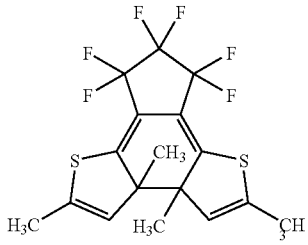

3b

It is recognized that other variations of dithienylethene materials may also serve as protective photochromic materials, these are summarized below.

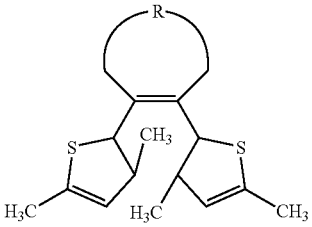

Where R can be any of the following functional groups:

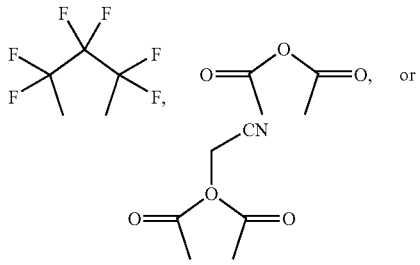

Structural variants of the dithienylethene molecule may also include the use of thiazole rings (X═N) in place of thiophene rings (X═C), for example:

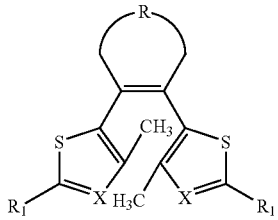

X═C or N $R_1$=—$CH_3$, —$CH_2CH_3$, —$CH_2CH_2CH_3$, —$C(CH_3)_3$, —$OCH_3$, —$C_6H_5$, $C_6H_4(OCH_3)$, —$CH_2CH(CH_2CH_3)CH_2CH_2CH_2CH_3$

Fused ring structures such as the one shown below may also be chosen as a protective photochromic material as well:

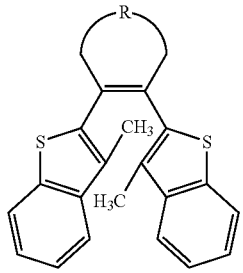

Where R can be any of the following functional groups:

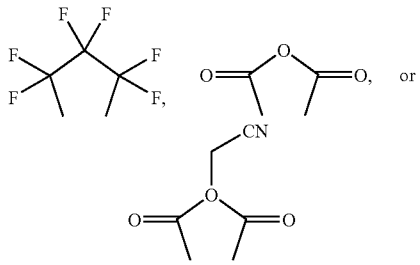

Other variations of the fused ring structures may also be chosen as a protective photochromic material as well:

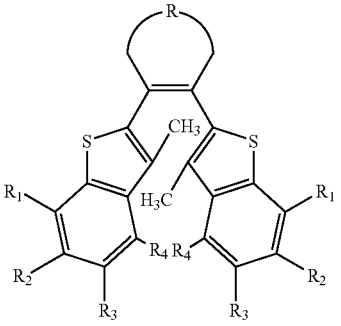

$R_1$, $R_2$, $R_3$, $R_4$=—$CH_3$, —$CH_2CH_3$, —$CH_2CH_2CH_3$, —$C(CH_3)_3$, —$OCH_3$, —$C_6H_5$, $C_6H_4(OCH_3)$, —$CH_2CH(CH_2CH_3)CH_2CH_2CH_2CH_3$

It should be recognized that other R groups may also be used in these structural variants of the photochromic protective material.

In furtherance of the exemplary embodiment, the document to be written is initially irradiated with UV light of wavelength less than 365 nm, for example 250 nm. This switches the PPL layer to a state that will transmit 365 nm UV light. The PPL layer is now in the UV transmissive form. Next, the document is irradiated with UV light of wavelength 365 nm. The UV light passes through the PPL and causes coloration (writing) of the PDL. In the final step, the PPL layer is irradiated with light to cause isomerization to the UV absorbing state. The PPL is now in the UV blocking form. Now, the document can be viewed in ambient light or sunlight without further coloration of the PDL and loss of contrast. This procedure requires that the PDL does not absorb at the wavelength where PPL is switched, i.e. 250 nm in this case. One approach to achieve this is to use an UV absorbing protective component in the PDL layer.

Another exemplary embodiment utilizes both PDL and PPL layers that can be altered with 365 nm UV light simultaneously. For example, if the coloration rate of the PDL is faster than the isomerization rate of the PPL, once the writing of the PDL is complete, the PPL more slowly undergoes the isomerization to the UV blocking form. The time for isomerization of the PPL and PDL can be adjusted by controlling the viscosity (in solutions, if the photochromic layer is disposed as a film made of capsules containing photochromic material in solution) or by tuning the glass transition (Tg) of the polymeric layer.

The exemplary embodiment provides transient documents with protection over the entire UV spectrum. Given the wide choice of photochromic materials and the simplicity of the protected paper (paper embedded with one or two coated layers) this protection method may provide transient documents which can be read for a defined period of time even in sunlight which contains strong intensity UV light. Previously made transient documents were subject to rapid coloration when exposed directly to sunlight, and they were not suitable for outdoor use.

The use of a switchable protective photochromic film to prevent overwriting/coloration of temporary documents by stray UV light from ambient light sources, while allowing writing of the transient document when needed, was demonstrated as follows.

Spiropyran (SPI) was utilized as the active imaging material. SPI transforms from a colorless state to a colored state when exposed to UV light (365 nm). The colored state exhibits a characteristic absorption band at 575 nm, and the material appears purple in color. After writing, the image is readable for a few hours, and after a longer period of time, such as 20 hours, it reverts back (thermally) to the blank state. The transient document is ready to be reimaged.

Dithienylethene (DTE) was used as the protective material placed as a top layer in a polymeric substrate. DTE changes from a colorless UV absorbing state to a pale yellow state when exposed to UV light (wavelength 365 nm). The material is thermally stable, and reverts back to the UV absorbing state after irradiation with light of wavelength greater than 440 nm.

Structures and switching between states are shown in Schemes 1 and 2, respectively.

Scheme 1. Spiropyran Imaging Material (SPI)

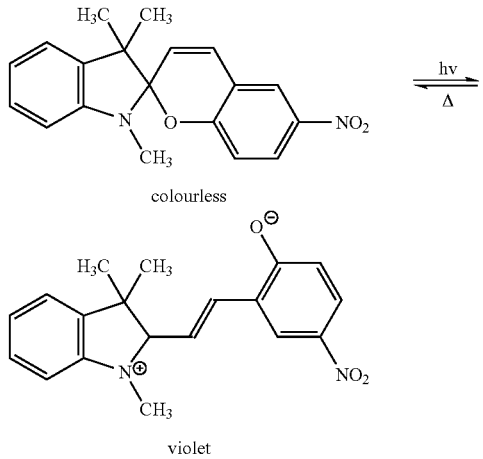

Scheme 2. Dithienylethene Protecting Materials (DTE)

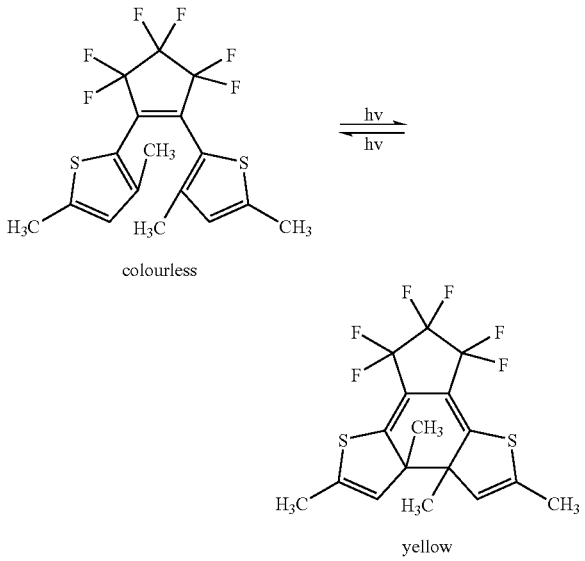

As provided by the exemplary embodiment, SPI films were prepared by spin-coating 2×2 cm quartz slides with a 2 weight % solution of SPI in 22 weight % poly(methylmethacrylate) (PMMA) dissolved in xylenes. Similarly, DTE films were prepared by spin-coating 1 weight % solution of DTE dissolved in 20 weight % poly (n-butylmethacrylate) in tetrahydrofuran (THF). The protected film device was made by depositing the DTE protective slide on top of the SPI imaging slide, which were held together with adhesive tape. Control films of pure SPI and pure DTE were made by covering the spin-coated films with a blank quartz slide. The corresponding structures are depicted in FIG. 4.

Figure 5:
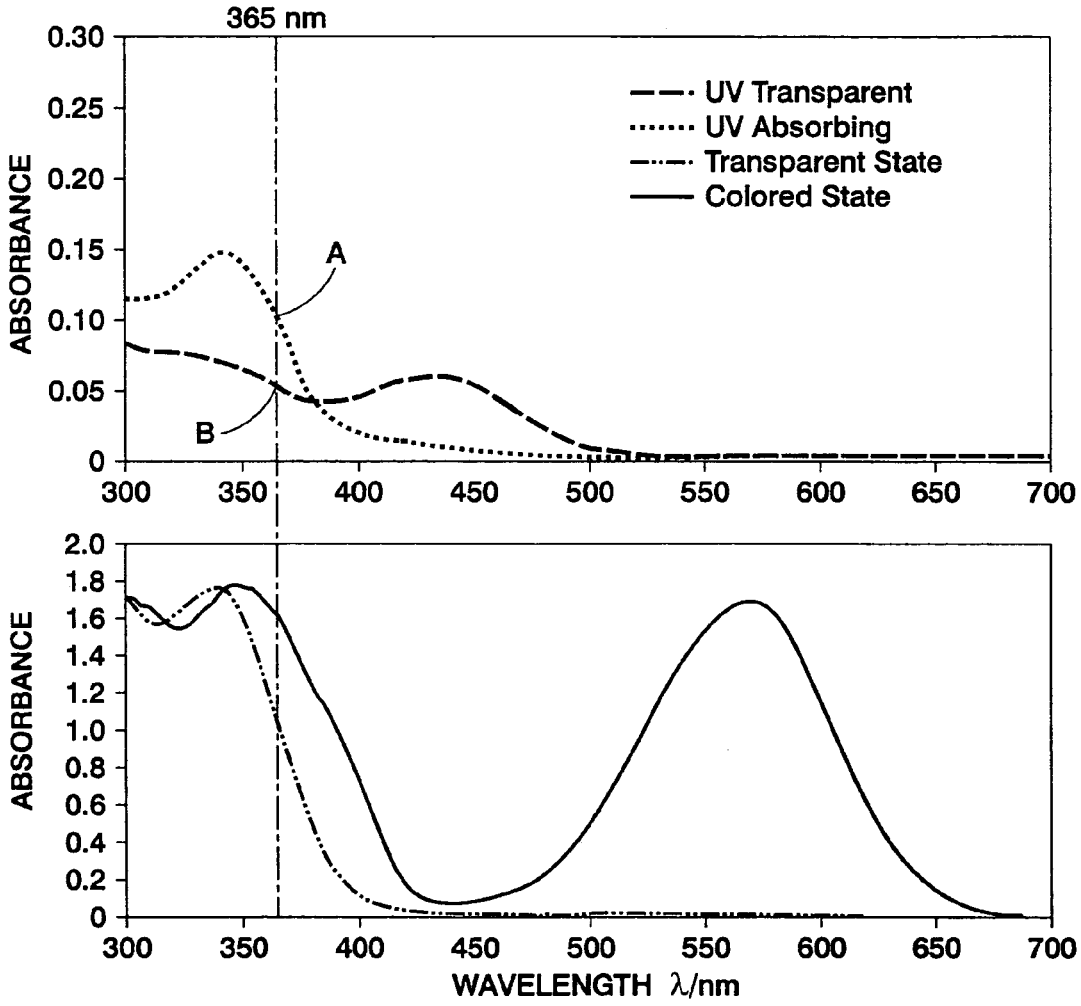
FIG. 5 is a graph of absorbance versus wavelengths of an exemplary embodiment member during a writing phase.

FIG. 5 illustrates protection of a transient document against ambient UV light, by using a switchable DTE protection layer. In the writing state, when the DTE/SPI device is illuminated with light the protecting top DTE layer undergoes isomerisation to the yellow state. The absorbance at the writing wavelength (365 nm) decreases significantly from point A to B. Most of the incident high intensity writing UV light passes through this layer and produces writing on the SPI layer (active writing media of transient documents). Blank areas of the document are not affected and remain white.

In the protection after reading state, after a few minutes, the top DTE protective layer reverts back to the UV absorbing state (shown in the top graph), while the written area of the document remains colored (SPI). When kept under ambient room light, the top DTE layer protects the blank areas from purple coloration because it absorbs the incident low intensity UV light. When absorbing, the top DTE layer may become slightly pale yellow but this does not have a significant detrimental impact on the contrast between written and blank areas of the document. If a protective layer is not present, blank areas of the document become too highly colored and contrast suffers significantly, as seen in FIG. 1.

Figure 6:
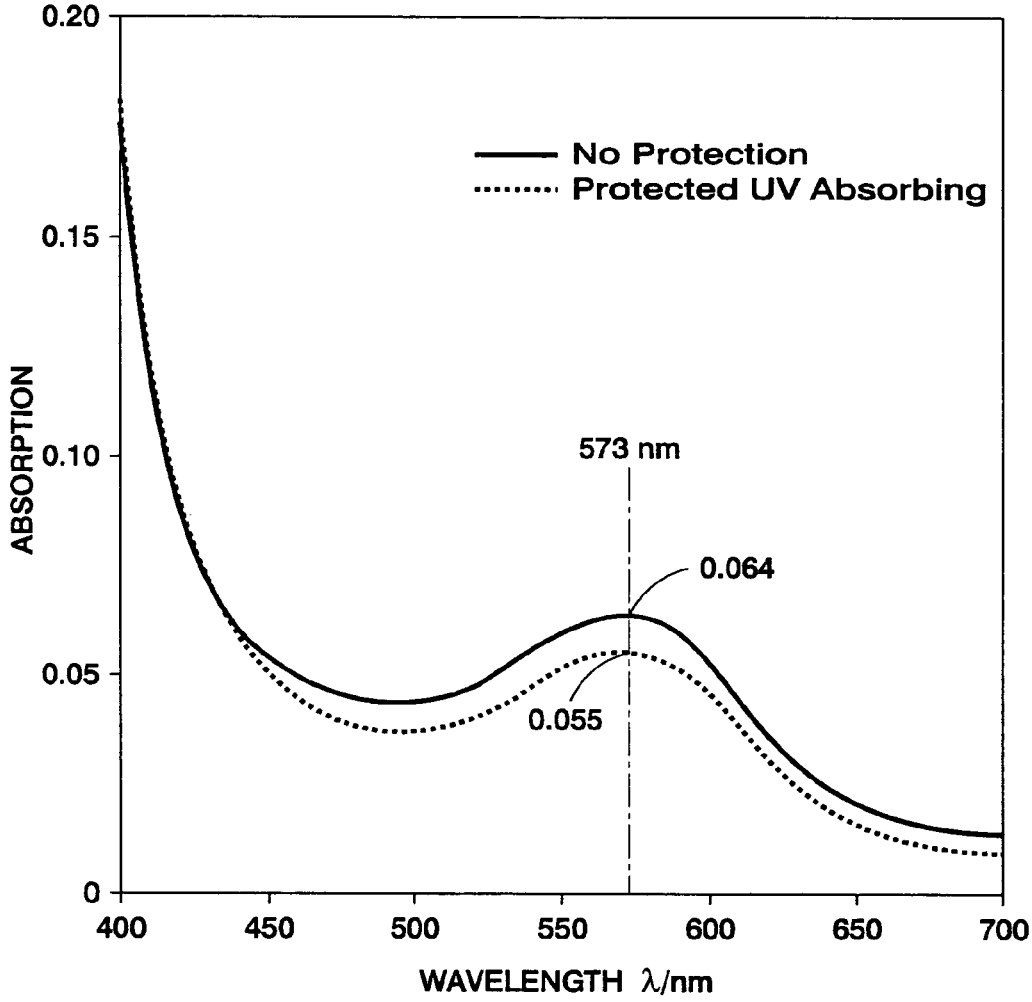
FIG. 6 is a chart of absorbance versus wavelength for an exemplary embodiment member.

A series of trials were conducted to further assess the exemplary embodiment. Coloration was estimated in all cases by increase of the absorption at 575 nm starting from a blank document after exposure to ambient light. This is the maximum absorbance of the colored state of the bottom layer in the colored state. Ambient UV light slowly colors blank areas. Referring to FIG. 6, the presence of the top DTE film showed some evidence of protection from indoor sunlight exposure, as seen from the reduction in absorbance in the 575 nm band of the initially blank region of the document (absorbance equal to 0.055), when compared with the unprotected document which has no switchable protective layer on top (absorbance equal to 0.063). This represents a decrease of coloration of protected blank areas of 13% when compared with an unprotected document. FIG. 6 demonstrates lower coloration of blank areas of the document by using a switchable photochromic protective layer.

Figure 7:
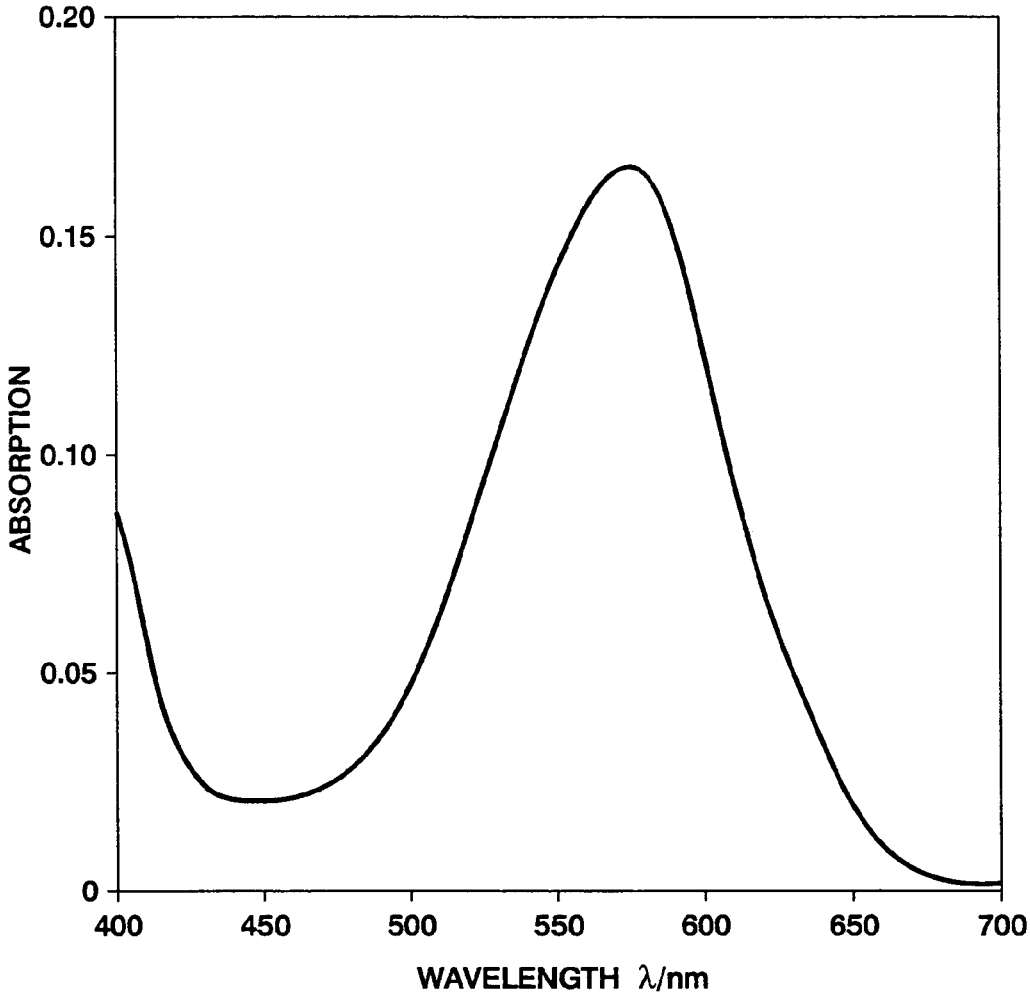
FIG. 7 is a graph of absorbance as a function of wavelength in a protected exemplary embodiment member.

It is significant that the writing on protected transient documents is still possible. This is demonstrated in FIG. 7. That figure illustrates a protected written document and absorption at 575 nm.

Thus, the exemplary embodiment provides a switchable protective photochromic film that minimizes the effect of stray UV light on the overwriting of temporary documents or other members.

Figure 8:
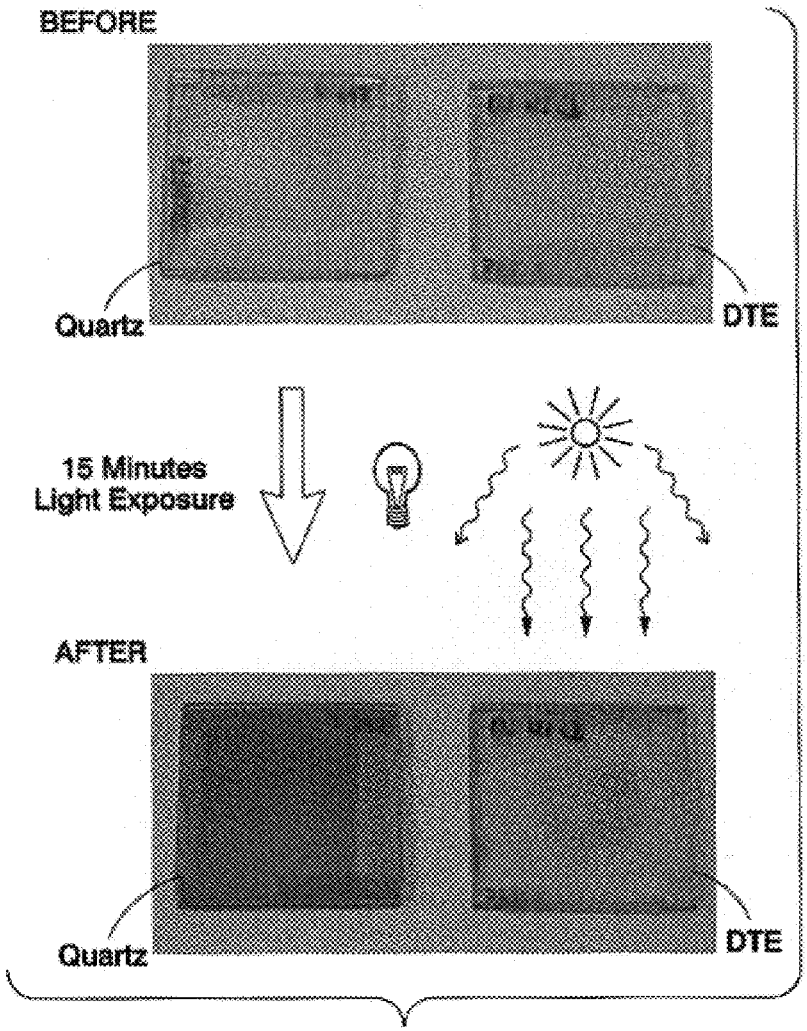
FIG. 8 is an illustration of before and after appearances of an exemplary embodiment member.
Figure 9:
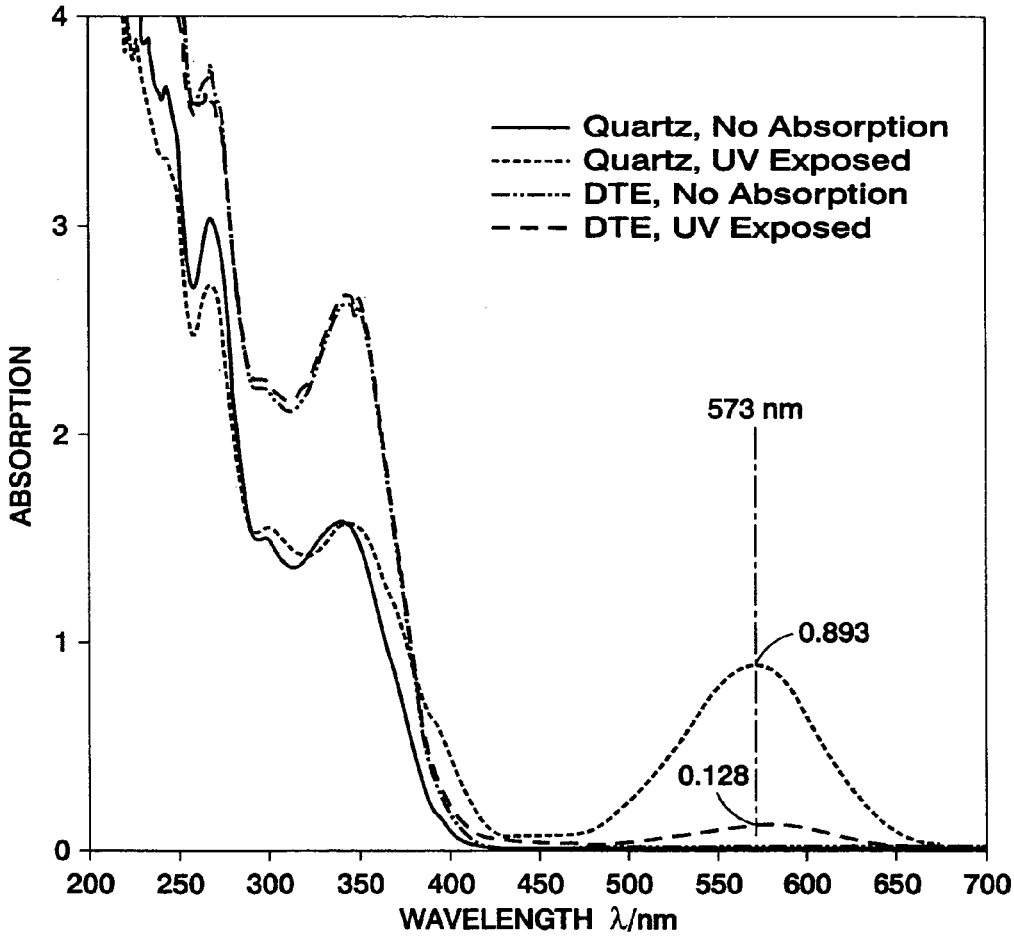
FIG. 9 is a graph of absorbance versus wavelength for certain layers in an exemplary embodiment member.

In another aspect, the exemplary embodiment provides protection of an SPI film against coloration. Referring to FIG. 8, a SPI coated quartz glass slide was covered with a DTE coated quartz glass slide, and the sandwiched assembly was exposed to an outdoor environment for 15 minutes. As a control, a SPI coated slide was covered with a blank quartz slide. Within minutes the purple coloration was clearly evident in the unprotected slide, while the colored slide showed little or no coloration. A trace of purple coloration was observed in the middle of the slide in the SPI/DTE assembly, due to uneven coating thickness in the DTE protective layer. Referring to FIG. 9, the absorption due to colored band at 573 nm was significantly reduced from 0.893 for the unprotected SPI film down to 0.128 for the SPI/DTE layered device. It is clearly evident from the photographs of FIG. 8 and the absorbance graph of FIG. 9 that the DTE layer is extremely effective at preventing the overwriting coloration on the SPI layer.

Figure 10:
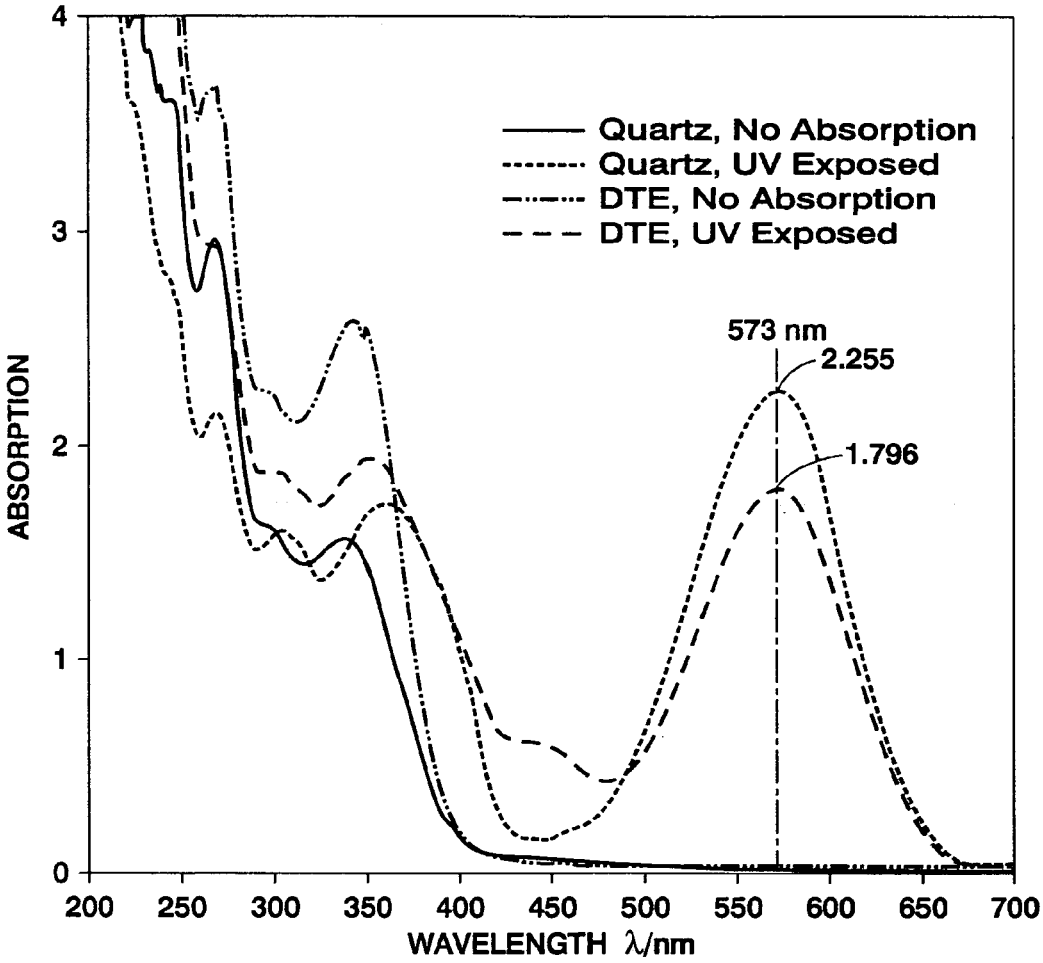
FIG. 10 is a graph of absorbance as a function of wavelength for certain layers in an exemplary embodiment member.

The exemplary embodiment also promotes writeability on SPI/DTE films. The second desired property of the DTE protective layer is that it should be at least partially transparent to high intensity UV light for intentional writing on the document. It is understood that the intensity of coloration will never be as much as for an unprotected film, but sufficient coloration must exist for an acceptable contrast ratio after writing. Referring to FIG. 10, after 60 seconds of irradiation with UV light, the absorbance intensity of an unprotected SPI film was 2.255. In comparison, the SPI/DTE dual layered structure showed an absorbance of 1.796, a reduced, yet still intense absorption. Again, the most intense coloration is present in the center of the SPI/DTE slide, where the DTE coating is thinnest. More uniform coloration can be created with a more uniform thickness of the protective DTE layer slide.

Using a protective DTE protective layer on top of a SPI writing layer, the SPI layer was protected against stray UV light in an outdoor environment. The coloration intensity was reduced from 0.893 to 0.128, as shown in FIG. 9. This protective DTE layer was demonstrated to be thin enough to still allow writing on the underlying SPI layer, as the absorbance for the unprotected SPI layer was 2.255, while in the covered SPI layer, the absorbance was 1.796. See FIG. 10.

This represents another aspect of the exemplary embodiment of using a switchable protective photochromic film to minimize the effect of stray UV light on the overwriting of temporary documents while still allowing writing with high intensity UV light.

It is recognized that improvements are still possible through further optimization, by directly coating the protecting film on top of the SPI film, and by improving the uniformity of the protective DTE layer for a more uniform protection/writeability of the underlying SPI layer.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A selectively imageable and protected member having an imaging state and a reading state, the member comprising:

a display layer, the display layer imageable upon exposure to light of a first wavelength and comprising a photochromic display material;

a protective layer disposed on the display layer, the protective layer being (i) at least substantially transparent to and non-absorbing of light of the first wavelength when the member is in the imaging state, and (ii) substantially non-transparent to and absorbing of light of the first wavelength when the member is in the reading state.

2. The member of claim 1 wherein the protective layer comprises at least one agent selected from the group consisting of chromenes (napthopyrans), diarylperfluorocyclopentenes, azobenzene derivatives, and combinations thereof.

3. The member of claim 1 wherein the first wavelength is about 365 nm.

4. The member of claim 1 wherein the display layer photochromic display material is spiropyran.

5. The member of claim 1 wherein the protective layer comprises dithienylethene.

6. The member of claim 1 wherein upon exposure to light of the first wavelength, the protective layer becomes substantially transparent to and non-absorbing of light of the first wavelength.

7. The member of claim 6 wherein after exposure to light of the first wavelength, the protective layer is substantially transparent to and non-absorbing of light of the first wavelength, and then after a period of time, the protective layer becomes substantially non-transparent and absorbing of light of the first wavelength.

8. The member of claim 7 wherein the period of time is from about 0.1 seconds to about 600 minutes.

9. The member of claim 1 wherein the protective layer transforms from the imaging state to the reading state upon exposure to light of a wavelength different than the first wavelength.

10. The member of claim 1 wherein the protective layer transforms from the reading state to the imaging state upon exposure to light of a wavelength different than the first wavelength.

11. A protected imageable member comprising:

a display layer imageable upon exposure to light of a first wavelength and comprising a photochromic display material; and a protective layer disposed on the display layer, the protective layer transforming from a first state in which the protective layer is substantially non-transparent to and absorbing of light of the first wavelength to a second state in which the protective layer is substantially transparent to and non-absorbing of light of the first wavelength upon exposure to light of the first wavelength, and after a period of time, reverting to the first state.

12. The member of claim 1 wherein the protective layer comprises at least one agent selected from the group consisting of chromenes (napthopyrans), diarylperfluorocyclopentenes, azobenzene derivatives, and combinations thereof.

13. The member of claim 11 wherein the first wavelength is about 365 nm.

14. The member of claim 11 wherein the photochromic display material is spiropyran.

15. The member of claim 11 wherein the protective layer comprises dithienylethene.

16. The member of claim 11 wherein the period of time is from about 1 second to about 60 minutes.

17. The member of claim 16 wherein the period of time is from about 10 seconds to about 30 minutes.

18. A protected imageable member comprising:

a display layer imageable upon exposure to light of a first wavelength and comprising a photochromic display material; and a protective layer disposed on the display layer, the protective layer comprising at least one agent selected from the group consisting of chromenes (napthopyrans), diaryperfluorocyclopentenes, azobenzene derivatives, and combinations thereof.

19. The protected member of claim 18 wherein the photochromic display material is spiropyran.

20. The protected member of claim 18 wherein the protective layer comprises dithienylethene.

* * * * *